US011222569B2

(12) United States Patent
Kim et al.

(10) Patent No.: US 11,222,569 B2
(45) Date of Patent: Jan. 11, 2022

(54) DISPLAY DRIVING DEVICE AND DISPLAY DEVICE INCLUDING THE SAME

(71) Applicant: Silicon Works Co., Ltd., Daejeon (KR)

(72) Inventors: Myung Yu Kim, Daejeon (KR); Do Seok Kim, Daejeon (KR); Hyun Pyo Cho, Daejeon (KR); Yong Hwan Moon, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

(21) Appl. No.: 16/925,296

(22) Filed: Jul. 9, 2020

(65) Prior Publication Data

US 2021/0193003 A1 Jun. 24, 2021

(30) Foreign Application Priority Data

Dec. 24, 2019 (KR) ..... 10-2019-0174233

(51) Int. Cl.
*G09G 3/20* (2006.01)

(52) U.S. Cl.
CPC ..... *G09G 3/20* (2013.01); *G09G 2310/0286* (2013.01); *G09G 2310/08* (2013.01); *G09G 2330/06* (2013.01)

(58) Field of Classification Search
CPC ..... G09G 3/20; G09G 2330/06; G09G 2310/0286; G09G 2310/08
See application file for complete search history.

(56) References Cited

U.S. PATENT DOCUMENTS

| | | | | |
|---|---|---|---|---|
| 9,191,700 | B2 * | 11/2015 | Choi | H04N 21/43635 |
| 9,210,010 | B2 * | 12/2015 | Whitby-Strevens | G09G 5/006 |
| 9,515,813 | B1 * | 12/2016 | Ganfield | H04L 25/03866 |
| 9,647,701 | B2 * | 5/2017 | Whitby-Strevens | H04L 25/4908 |
| 9,661,350 | B2 * | 5/2017 | Whitby-Strevens | G09G 5/006 |
| 9,710,968 | B2 * | 7/2017 | Dillavou | G06T 19/006 |
| 9,838,226 | B2 * | 12/2017 | Whitby-Strevens | H04B 1/0475 |
| 9,887,840 | B2 * | 2/2018 | Bartley | H04L 9/0662 |
| 10,684,981 | B2 * | 6/2020 | Pitigoi-Aron | G06F 13/4291 |
| 10,923,070 | B2 * | 2/2021 | Zhou | G06F 3/147 |
| 10,971,048 | B2 * | 4/2021 | Zhou | H04B 1/04 |
| 2010/0138729 | A1 * | 6/2010 | Chen | H04L 1/244 714/811 |
| 2011/0032421 | A1 * | 2/2011 | Kota | G09G 5/18 348/500 |
| 2014/0344650 | A1 * | 11/2014 | Au | H04N 7/10 714/776 |
| 2016/0164705 | A1 * | 6/2016 | Whitby-Strevens | G09G 5/006 375/259 |

(Continued)

FOREIGN PATENT DOCUMENTS

| | | | |
|---|---|---|---|
| KR | 20090055404 | B1 | 6/2009 |
| KR | 20120059351 | B1 | 6/2012 |

(Continued)

*Primary Examiner* — Grant Sitta
(74) *Attorney, Agent, or Firm* — Polsinelli PC

(57) ABSTRACT

The present disclosure discloses a display driving device and a display device including the same, which allow transmission data to be converted into a completely random code sequence. The display device may scramble transmission data into a pseudo-random binary sequence (PRBS) using a linear feedback shift register (LFSR), and may change a seed value of the LFSR every time the scrambling is performed.

11 Claims, 5 Drawing Sheets

(56) References Cited

U.S. PATENT DOCUMENTS

2019/0371227 A1* 12/2019 Choi ..... G09G 3/2092

FOREIGN PATENT DOCUMENTS

KR 20170080232 A 7/2017
KR 20200030853 A 3/2020

* cited by examiner

DISPLAY DRIVING DEVICE AND DISPLAY DEVICE INCLUDING THE SAME

CROSS-REFERENCE TO RELATED APPLICATION

This application claims priority to and the benefit of Korean Patent Application No. 2019-0174233, filed on Dec. 24, 2019, the disclosure of which is incorporated herein by reference in its entirety.

BACKGROUND

Field of the Invention

The present disclosure relates to a display device, and more particularly, to a display driving device and a display device including the same, which allow electromagnetic interference (EMI) to be improved.

Discussion of Related Art

Generally, display devices include a display panel, a source driver, a timing controller, and the like.

The source driver converts digital image data provided from the timing controller into data voltage and provides the data voltage to the display panel. The source driver may be integrated into an integrated circuit chip (IC chip) and may be configured as a plurality of IC chips in consideration of the size and resolution of the display panel.

Meanwhile, a scrambling technique has been applied to reduce electromagnetic interference (EMI) generated in a transmission line. A plurality of data lines are connected between a timing controller and source drivers, and EMI may be generated due to the transmission of data patterns on a corresponding data line.

A display device according to the related art converts transmission data into a code sequence using a code having a fixed seed value to reduce EMI. However, in the related art, since the transmission data is converted into a code sequence using a fixed seed value, there is a problem in that a certain pattern, which is not completely random, is continuously generated. Accordingly, an EMI reduction effect may be halved.

SUMMARY OF THE INVENTION

The present disclosure is directed to providing a display driving device and a display device including the same, which allow transmission data to be converted into a completely random code sequence.

According to an aspect of the present disclosure, there is provided a display device including a timing controller configured to scramble transmission data into a pseudo-random-binary sequence (PRBS) using a linear feedback shift register (LFSR), include the PRBS in a communication signal, and transmit the communication signal, and a source driver configured to receive the communication signal, descramble the PRBS included in the communication signal to the transmission data, and drive a display panel using the transmission data. The timing controller may change a seed value of the LFSR in a scramble reset.

According to another aspect of the present disclosure, there is provided a display driving device including at least one source driver configured to receive a communication signal including a pseudo-random-binary sequence (PRBS) obtained by scrambling transmission data using a linear feedback shift register (LFSR), descramble the PRBS to the transmission data, and drive a display panel using the transmission data. A seed value of the LFSR may be set to be changed in a scramble reset, and the source driver may check the seed value of the LFSR in descrambling and descramble the PRBS to the transmission data using the seed value.

BRIEF DESCRIPTION OF THE DRAWINGS

The above and other objects, features, and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Embodiments disclose a display driving device and a display device including the same, which enable an electromagnetic interference (EMI) reduction effect to be improved by converting transmission data into a completely random code sequence.

Embodiments disclose a display driving device and a display device including the same, which allow the time for a configuration mode operating at a low frequency to be reduced by defining the length of a data packet, which is variable, in a header to support high-speed data communication.

Embodiments disclose a display driving device and a display device including the same, which enable a communication abnormal state to be restored to a normal state when a communication abnormality occurs due to an unexpected variable during communication between a timing controller and source drivers.

In embodiments, a restoration protocol or a recovery mode may be defined as a protocol or a mode that makes the communication states between a timing controller and source drivers in the same state.

In embodiments, a configuration protocol, a configuration mode, or a configuration period may be defined as a protocol, a mode, or a period for setting an option of Internet Protocol (IP) of communication links operating at high speed in a display mode, an option of a clock data recovery circuit of a source driver, an option for pre-clock training, and an equalizer option.

In embodiments, a display mode or a display period may be defined as a mode or a period for processing configuration data and image data of a source driver.

In embodiments, pre-clock training or a bandwidth setting period may be defined as a mode or a period for searching for and setting an optimal frequency bandwidth of communication links operating at high speed in a display mode.

In embodiments, equalizer training or an equalizer period may be defined as a mode or a period for setting an equalizer gain level to improve the characteristics of communication links operating at high speed in a display mode.

In embodiments, a scrambling protocol may be defined as a promised protocol between a timing controller and source drivers, in which the timing controller scrambles transmission data in a random code sequence and transmits the random code sequence to the source driver, and the source driver restores the transmission data by descrambling the random code sequence.

In embodiments, terms "first," "second," and the like may be used for the purpose of distinguishing a plurality of elements from one another. Here, the terms "first," "second," and the like are not intended to limit the elements.

Figure 1:
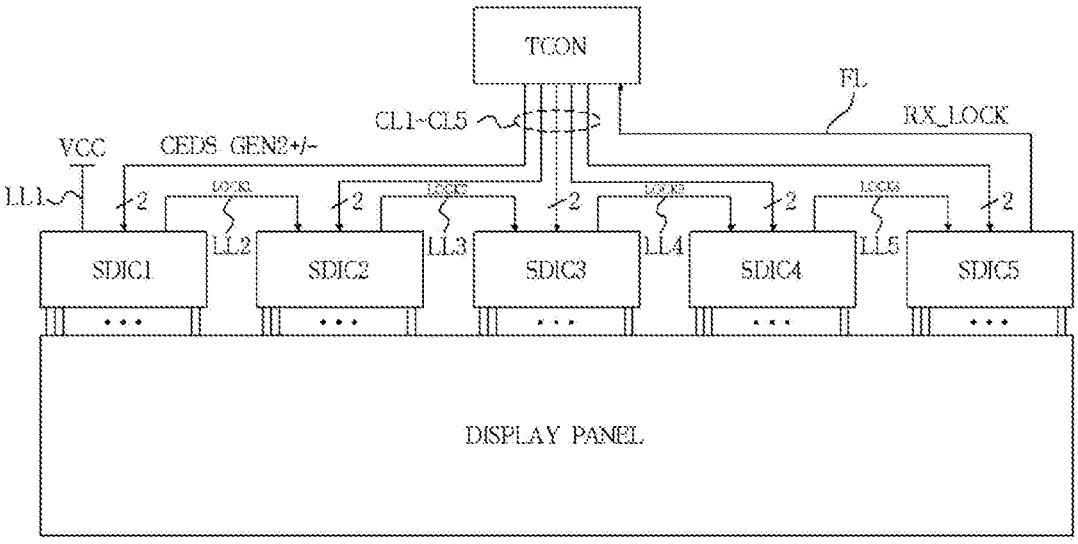
FIG. 1 is a block diagram of a display device according to one embodiment.

FIG. 1 is a block diagram of a display device according to one embodiment.

Referring to FIG. 1, the display device may include a timing controller TCON, a plurality of first to fifth source drivers SDIC1 to SDIC5, and a display panel.

The timing controller TCON may be connected to the plurality of first to fifth source drivers SDIC1 to SDIC5 through first to fifth communication links CL1 to CL5 in a point-to-point manner.

As an example, the timing controller TCON may be connected to the first source driver SDIC1 through the first communication link CL1, and the timing controller TCON may be connected to the second source driver SDIC2 through the second communication link CL2. The timing controller TCON may be connected to the third source driver SDIC3 through the third communication link CL3, and the timing controller TCON may be connected to the fourth source driver SDIC4 through the fourth communication link CL4. The timing controller TCON may be connected to the fifth source driver SDIC5 through the fifth communication link CL5. In addition, each of the first to fifth communication links CL1 to CL5 may be configured as a pair of differential signal lanes.

The timing controller TCON may provide a communication signal CEDS GEN2+/− to the source drivers SDIC1 to SDIC5 through the first to fifth communication links CL1 to CL5, respectively.

In addition, the first to fifth source drivers SDIC1 to SDIC5 may be connected to each other through first to fifth lock links LL1 to LL5 in a cascade manner.

As an example, a power voltage terminal VCC may be connected to the first source driver SDIC1 through the first lock link LL1. The first source driver SDIC1 may be connected to the second source driver SDIC2 through the second lock link LL2, and the second source driver SDIC2 may be connected to the third source driver SDIC3 through the third lock link LL3. The third source driver SDIC3 may be connected to the fourth source driver SDIC4 through the fourth lock link LL4, and the fourth source driver SDIC4 may be connected to the fifth source driver SDIC5 through the fifth lock link LL5. In addition, the fifth source driver SDIC5, which is the last one, may be connected to the timing controller TCON through a feedback link FL.

The first source driver SDIC1 may transmit a first lock signal LOCK1 to the second source driver SDIC2 through the second lock link LL2, and the second source driver SDIC2 may transmit a second lock signal LOCK2 to the third source driver SDIC3 through the third lock link LL3. The third source driver SDIC3 may transmit a third lock signal LOCK3 to the fourth source driver SDIC4 through the fourth lock link LL4, and the fourth source driver SDIC4 may transmit a fourth lock signal LOCK4 to the fifth source driver SDIC5 through the fifth lock link LL5. In addition, the fifth source driver SDIC5 may transmit a fifth lock signal RX_LOCK to the timing controller TCON through the feedback link FL. Here, the fifth lock signal RX_LOCK may indicate a communication state of at least one of the first to fifth source drivers SDIC1 to SDIC5. The fifth lock signal RX_LOCK may be switched to have a value indicating a communication abnormal state when a lock failure occurs in at least one of the first to fifth source drivers SDIC1 to SDIC5.

Figure 2:
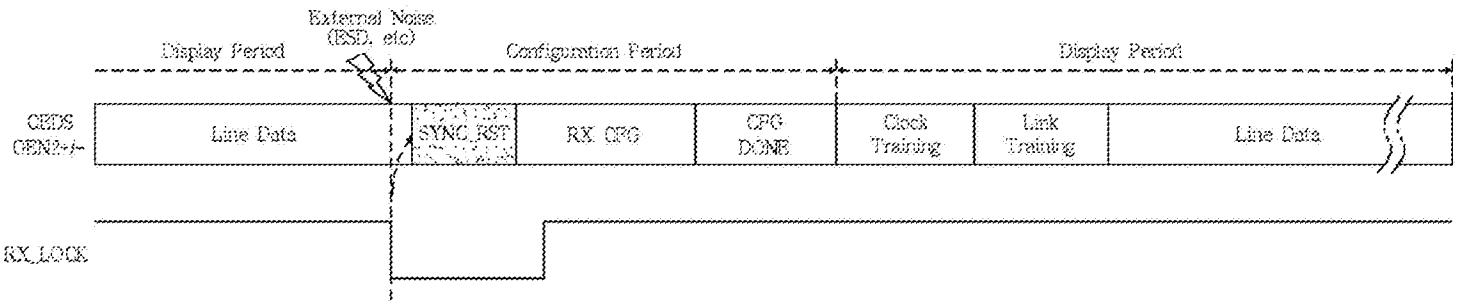
FIG. 2 is a diagram for describing a restoration protocol of the display device according to one embodiment.

FIG. 2 is a diagram for describing a restoration protocol of the display device according to one embodiment.

Referring to FIG. 2, when the communication abnormal state occurs due to external noise such as an electrostatic discharge (ESD) while performing a display mode, the display device may be switched from the display mode to a configuration mode.

As an example, when a lock failure occurs in at least one of the first to fifth source drivers SDIC1 to SDIC5, the fifth source driver SDIC5 may switch the level of the fifth lock signal RX_LOCK from a high level to a low level and provide the fifth lock signal RX_LOCK to the timing controller TCON.

When the lock failure occurs, the timing controller TCON may include a restore command SYNC_RST, for restoring the communication state, in the communication signal CEDS GEN2+/− and transmit the communication signal CEDS GEN2+/− to the first to fifth source drivers SDIC1 to SDIC5 through the first to fifth communication links CL1 to CL5.

As an example, the timing controller TCON may transmit the restore command SYNC_RST having a predetermined level for a predetermined period of time. In addition, the timing controller TCON may transmit a configuration data packet RX CFG to the first to fifth source drivers SDIC1 to SDIC5 after transmitting the restore command SYNC_RST for the predetermined period of time.

The first to fifth source drivers SDIC1 to SDIC5 may receive the restore command SYNC_RST and the configuration data packet RX CFG, and may perform a configuration mode according to the configuration data packet RX CFG. Here, the configuration mode may be defined as a mode for setting an IP option of the first to fifth communication links CL1 to CL5 operating at high speed in the display mode.

In addition, the configuration mode may be set to operate in a low-frequency band compared to the display mode.

In addition, the timing controller TCON may transmit configuration completion data CFG DONE to the first to fifth source drivers SDIC1 to SDIC5 after transmitting the entire configuration data packet RX CFG.

As an example, the timing controller TCON may transmit the configuration completion data CFG DONE, which has a value in which 0 and 1 are continuously toggled for a predetermined period of time, to the first to fifth source drivers SDIC1 to SDIC5.

In addition, when the first to fifth source drivers SDIC1 to SDIC5 receive the configuration completion data CFG DONE from the timing controller TCON, the first to fifth source drivers SDIC1 to SDIC5 may be switched from the configuration mode to the display mode.

The first to fifth source drivers SDIC1 to SDIC5 may restore a phase lock loop (PLL) clock of an internal clock data recovery circuit (not shown) by performing clock training in a display period.

Next, after the clock training in the display period, the first to fifth source drivers SDIC1 to SDIC5 may lock symbol boundary detection and a symbol clock by performing link training.

Next, after the link training in the display period, the first to fifth source drivers SDIC1 to SDIC5 may receive frame data transmitted from the timing controller TCON, convert line data included in the frame data into a data voltage, and provide the data voltage to the display panel.

Figure 3:
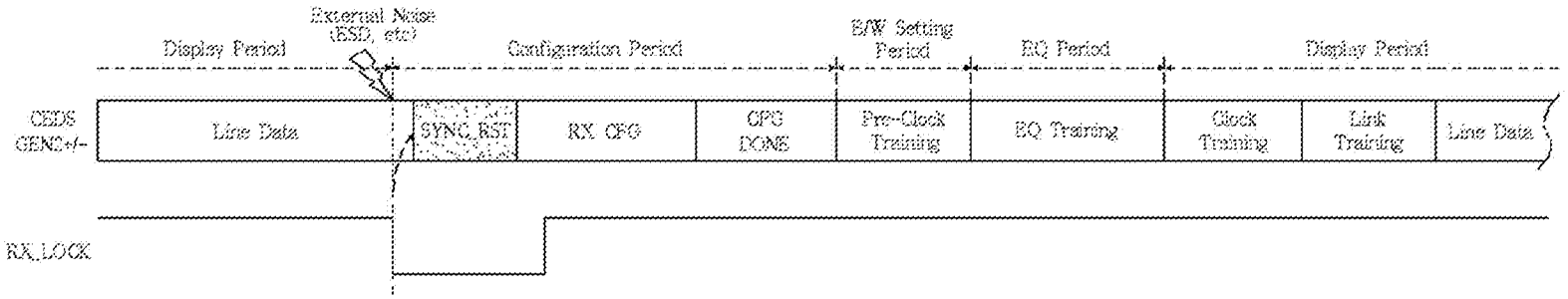
FIG. 3 is a diagram for describing a restoration protocol of a display device according to another embodiment.

FIG. 3 is a diagram for describing a restoration protocol of a display device according to another embodiment. In describing FIG. 3, the description that overlaps that of the embodiment described with reference to FIG. 2 is replaced by the description of FIG. 2.

Referring to FIG. 3, when a communication abnormal state occurs due to external noise, the timing controller TCON may transmit a restore command SYNC_RST having a predetermined level to the first to fifth source drivers SDIC1 to SDIC5 for a predetermined period of time.

Next, after the restore command SYNC_RST is transmitted for the predetermined period of time, the timing controller TCON may transmit a configuration data packet RX CFG to the first to fifth source drivers SDIC1 to SDIC5.

As an example, the timing controller TCON may include a pre-clock training option and an equalizer training option in the configuration data packet RX CFG when transmitting the configuration data packet RX CFG to the first to fifth source drivers SDIC1 to SDIC5.

Next, after a configuration mode is completed, the first to fifth source drivers SDIC1 to SDIC5 may perform pre-clock training to set an optimal frequency bandwidth of the first to fifth communication links CL1 to CL5 operating at high speed in a display mode.

Next, after the pre-clock training is completed, the first to fifth source drivers SDIC1 to SDIC5 may perform equalizer training to set an equalizer gain level in which the characteristics of the communication links operating at high speed in the display mode may be improved.

As an example, the timing controller TCON may repeatedly transmit the pattern of equalizer clock training and equalizer link training during an equalizer period as many times as set in the previous configuration mode.

The first to fifth source drivers SDIC1 to SDIC5 may change the level of the equalizer gain level by a value set in the previous configuration mode.

In addition, each of the first to fifth source drivers SDIC1 to SDIC5 may check locking, symbol locking, and the number of errors of the clock data recovery circuit according to the equalizer gain level thereof.

In addition, the first to fifth source drivers SDIC1 to SDIC5 may compare locking, symbol locking, and the number of errors of the clock data recovery circuit according to the equalizer gain level to select the most effective equalizer gain level, and set the first to fifth communication links CL1 to CL5 accordingly.

Here, the pre-clock training and the equalizer training may be set to operate in a high-frequency band compared to the configuration mode.

In addition, the first to fifth source drivers SDIC1 to SDIC5 may be switched to the display mode after completing the equalizer training.

The first to fifth source drivers SDIC1 to SDIC5 may restore a PLL clock by performing the clock training in the display mode, and may lock symbol boundary detection and a symbol clock by performing the link training.

In addition, the first to fifth source drivers SDIC1 to SDIC5 may convert line data transmitted from the timing controller TCON into a data voltage, and provide the data voltage to the display panel.

As described above, according to the embodiments, when the communication abnormality occurs between the timing controller and the source driver due to unexpected variables, the communication abnormal state may be restored to a normal state at the desired time, thereby preventing a communication failure.

Figure 4:
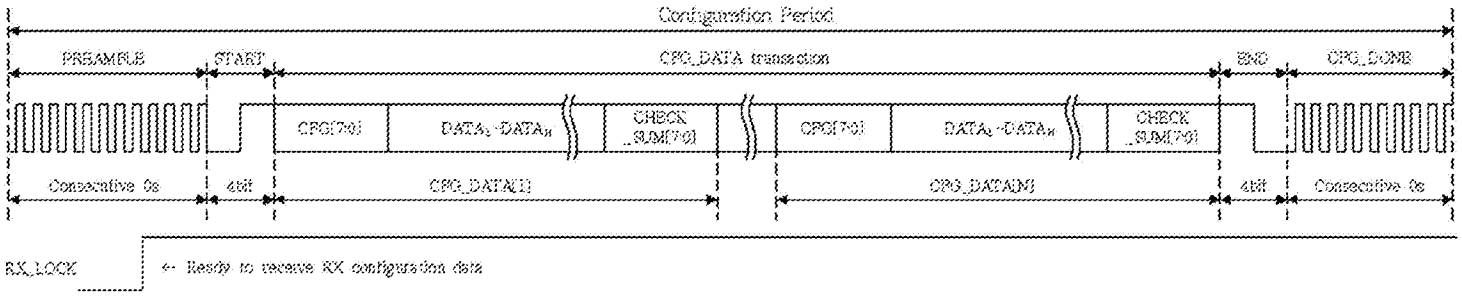
FIG. 4 is a diagram for describing a configuration protocol of the display device according to one embodiment.

FIG. 4 is a diagram for describing a configuration protocol of the display device according to one embodiment. Hereinafter, for convenience of explanation, a case in which communication is performed between the timing controller and one source driver will be described as an example.

Referring to FIG. 4, the source driver may receive a communication signal having a format of preamble data PREAMBLE, start data START, configuration data CFG_DATA, end data END, and configuration completion data CFG_DONE from the timing controller TCON in a configuration mode. The configuration data CFG_DATA may include a header CFG[7:0] that defines the length of data packets DATA1 to DATAN.

The configuration data CFG_DATA may have a format of the header CFG[7:0], the data packets DATA1 to DATAN, and a checksum CHECK_SUM[7:0].

The header CFG[7:0] may define the number of bytes of the data packets DATA1 to DATAN of the current transaction. In addition, the header CFG[7:0] may define the total number of sequences CFG_DATA[1] to CFG_DATA[N] of the configuration data CFG_DATA. In addition, the header CFG[7:0] may define whether the checksum CHECK_SUM [7:0] is activated.

As an example, the header CFG[7:0] may be composed of 8 bits, and a [0] bit of the header CFG[7:0] may be used for synchronization, [3:1] bits of the header CFG[7:0] may be used to define the number of bytes of the data packets DATA1 to DATAN of the current transaction, [6:4] bits of the header CFG[7:0] may be used to define the total number of the sequences CFG_DATA[1] to CFG_DATA[N] of the configuration data CFG_DATA. In addition, a [7] bit of the header CFG[7:0] may define whether the checksum CHECK_SUM[7:0] is activated.

First, the source driver may receive the preamble data PREAMBLE, which is continuously toggled between levels of 0 and 1, in the configuration mode.

Next, when the source driver continuously receives the preamble data PREAMBLE for a predetermined period of time, the source driver may transmit a lock signal RX_LOCK indicating that the source driver is ready to receive the configuration data CFG_DATA to the timing controller TCON. As an example, the source driver may provide the lock signal RX_LOCK by switching from a low level to a high level.

Next, the timing controller TCON may transmit the start data START, the configuration data CFG_DATA, the end data END, and the configuration completion data CFG_DONE to the source driver in response to the lock signal RX_LOCK. Here, the start data START may be set to a level of "0011," and the end data END may be set to a level of "1100."

Next, after the end data END of "1100" is received, the source driver may receive the configuration completion data CFG_DONE continuously toggled between levels of 0 and 1.

Next, when the source driver receives the configuration completion data CFG_DONE for a predetermined period of time, the source driver may perform pre-clock training, equalizer training, or a display mode according to the configuration data CFG_DATA.

Figure 5:
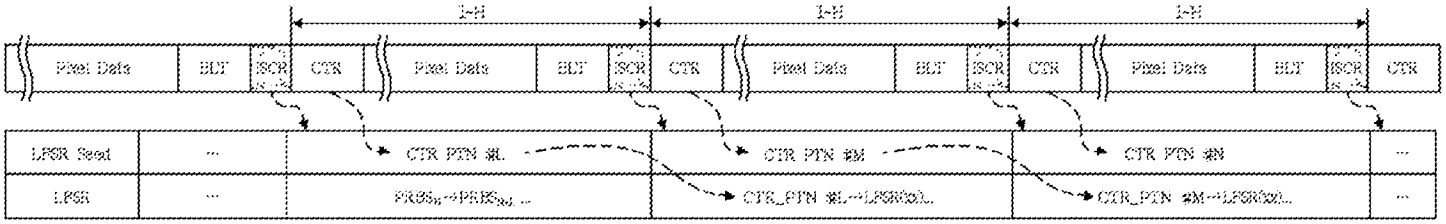
FIG. 5 is a diagram for describing a scrambling protocol of the display device according to one embodiment.

FIG. 5 is a diagram for describing a scrambling protocol of the display device according to one embodiment.

The timing controller TCON may scramble transmission data into a pseudo-random binary sequence (PRBS) using a linear feedback shift register (LFSR), and the timing controller TCON may include the PRBS in a communication signal and transmit the communication signal to the source driver SDIC. The transmission data may include at least one of a control data packet, image data, and a data checksum.

As an example, the timing controller TCON may include a scrambler (not shown) for scrambling the transmission data. The scrambling is the process of mixing every bit of the transmission data to be transmitted, and may prevent the same bit, for example, 1 or 0, from being continuously placed over K (here K is a natural number greater than or equal to 2) times in a data transmission stream. The scrambling may be performed according to a previously agreed protocol.

The LFSR is a type of shift register and may have a structure in which a value input to the register is calculated as a linear function of previous state values. As an example, the LFSR may use an exclusive-or (XOR) operation as a linear function. Here, the value of initial bits of the LFSR may be called a seed, and since the operation of the LFSR is deterministic, the sequence of values generated by the LFSR may be determined by the previous value. In addition, since the number of values that the register can have is finite, the sequence may be repeated at a particular period.

The timing controller TCON may periodically change the seed value of the LFSR. As an example, the timing controller TCON may change the seed value at a frame interval or a line interval. In addition, the timing controller TCON may change the seed value using the control data packet. As another example, the timing controller TCON may change the seed value using at least one of the image data and the data checksum.

The timing controller TCON may calculate the value of the transmission data, which is input to the LFSR, and the state values of the previous transmission data by a linear function to scramble the transmission data.

In addition, the timing controller TCON may include the PRBS, which is obtained by scrambling the transmission data, in the communication signal, and may transmit the communication signal to the source driver through the communication link.

The source driver SDIC may receive the communication signal from the timing controller TCON through the communication link, and may descramble the PRBS included in the communication signal to the transmission data. In addition, the source driver SDIC may drive the display panel using the transmission data.

As an example, the source driver SDIC may include a descrambler (not shown) configured to descramble the PRBS to the transmission data. The descrambler may perform a function of restoring the stream, in which each bit is mixed with each other, back to the original data.

The source driver SDIC may receive a scramble reset signal in a blank link training period.

As an example, the source driver SDIC may descramble the PRBS using at least one of a control data packet, image data, and a data checksum transmitted as transmission data of a previous horizontal line when a scramble reset signal ISCR is activated.

As described above, the timing controller TCON may perform the scramble reset at regular intervals, and may change the seed value using at least one of the control data packet, the image data, and the data checksum transmitted as the transmission data every time the scramble reset is performed.

Then, the source driver SDIC may descramble the PRBS using at least one of the control data packet, the image data, and the data checksum transmitted as the previous transmission data.

The timing controller TCON and the source driver SDIC may perform both high-speed data communication and low-speed data communication, and the above-described transmission and reception of the control data packet, the image data, and the data checksum may be performed through the high-speed data communication.

A clock and a link are trained for the high-speed data communication in a display period, and the control data packet, the image data, and the data checksum may be transmitted and received according to the trained clock and link. In the display mode of the display period, the transmission and reception of the transmission data, which includes the control data packet, the image data, and the data checksum in frame and line units, may be repeated after the clock training and the link training have been performed.

Since the transmission data is transmitted and received through the high-speed data communication in the display mode, the reception rate of data may be changed according to a set value for the communication. In order to increase the reception rate and allow the high-speed data communication to be smoothly performed, the timing controller TCON and the source driver SDIC may transmit and receive information for supporting the high-speed data communication through the low-speed data communication. The description related to this is replaced with the description of FIG. 2.

According to the embodiments described above, an electromagnetic interference (EMI) reduction effect may be improved by converting the transmission data into a completely random code sequence.

In addition, according to the embodiments, it is possible to use a low order polynomial by controlling the seed value in the method of generating the PRBS using the LFSR, so that the size of a source driver chip may be reduced.

According to the embodiments described above, an electromagnetic interference (EMI) reduction effect can be improved by converting transmission data into a completely random code sequence.

In addition, according to the embodiments, a polynomial of small order can be used by controlling a seed value in a method of generating a pseudo-random binary sequence (PRBS) using a linear feedback shift register (LFSR), so that the size of a source driver chip can be reduced.

What is claimed is:

1. A display device comprising:

a timing controller configured to scramble transmission data into a pseudo-random-binary sequence (PRBS) using a linear feedback shift register (LFSR), include the PRBS in a communication signal, and transmit the communication signal; and a source driver configured to receive the communication signal, descramble the PRBS included in the communication signal to the transmission data, and drive a display panel using the transmission data, wherein the timing controller changes a seed value of the LFSR in a scramble reset, and the timing controller changes the seed value at least one interval of a frame interval and a horizontal line interval.

2. The display device of claim 1, wherein the timing controller periodically changes the seed value.

3. The display device of claim 1, wherein the timing controller changes the seed value using at least one of a control data packet, image data, and a data checksum.

4. The display device of claim 1, wherein the timing controller calculates a value of the transmission data, which is input to the LFSR, and state values of previous transmission data by a linear function to scramble the transmission data.

5. The display device of claim 1, wherein the source driver receives a scramble reset signal in a blank link training period.

6. The display device of claim 5, wherein, when the scramble reset signal is activated, the source driver descrambles the PRBS using at least one of a control data packet, image data, and a data checksum input as transmission data of a previous horizontal line.

7. The display device of claim 1, wherein the timing controller performs a scramble reset at regular intervals, and changes the seed value using at least one of a control data packet, image data, and a data checksum transmitted as the transmission data in the scramble reset.

8. A display driving device comprising at least one source driver configured to receive a communication signal including a pseudo-random-binary sequence (PRBS) obtained by scrambling transmission data using a linear feedback shift register (LFSR), descramble the PRBS to the transmission data, and drive a display panel using the transmission data, wherein a seed value of the LFSR is set to be changed in a scramble reset, and the source driver checks the seed value of the LFSR in descrambling and descrambles the PRBS to the transmission data using the seed value, and the source driver receives the scramble reset signal at least one interval of a frame interval and a horizontal line interval.

9. The display driving device of claim 8, wherein the source driver receives a scramble reset signal in a blank link training period.

10. The display driving device of claim 9, wherein the source driver receives the scramble reset signal at regular intervals.

11. The display driving device of claim 10, wherein, when the scramble reset signal is activated, the source driver descrambles the PRBS using at least one of a control data packet, image data, and a data checksum transmitted as transmission data of a previous frame or previous horizontal line.

* * * * *